United States Patent [19]

Lewis et al.

[11] Patent Number: 4,648,858

[45] Date of Patent: Mar. 10, 1987

[54] APPARATUS FOR MANUFACTURING A CIGARETTE FILTER TOW

[75] Inventors: Robert T. Lewis; James W. Sullivan; Kenneth M. Milliner, all of Louisville; Byron L. Lowe, Prospect, all of Ky.

[73] Assignee: Brown & Williamson Tobacco Corporation, Louisville, Ky.

[21] Appl. No.: 781,170

[22] Filed: Sep. 30, 1985

[51] Int. Cl.[4] ..... B31C 13/00

[52] U.S. Cl. ..... 493/4; 156/441; 493/10; 493/21; 493/24; 493/42; 493/47

[58] Field of Search ..... 493/4, 10, 21, 24, 40, 493/42, 47, 48, 49, 46; 156/180, 441

[56] References Cited

U.S. PATENT DOCUMENTS 3,860,011 1/1975 Norman ..... 131/340

4,179,323 12/1979 Sigmon ..... 493/47

4,582,587 4/1986 Grollimund ..... 493/42

*Primary Examiner*—Frederick R. Schmidt

*Assistant Examiner*—Robert Showalter

*Attorney, Agent, or Firm*—Charles G. Lamb

[57] ABSTRACT

An apparatus for manufacturing a filter rod having a hollow tube extending longitudinally through the filter rod. The apparatus includes a supply reel of hollow tubing, a supply of filter material web, and a garniture funnel into which the filter material web and hollow tubing are continuously, concurrently fed for wrapping the filter material web into a cylindrical configuration enclosing the hollow tube longitudinally therein. The apparatus also includes a plasticizer or adhesive applicator for coating the outside wall surface of the tube with a plasticizer or adhesive before it is fed into the garniture funnel, and a tube guide nozzle located at the inlet to the garniture funnel for positioning and guiding the hollow tube into the garniture funnel.

14 Claims, 2 Drawing Figures

APPARATUS FOR MANUFACTURING A CIGARETTE FILTER TOW

BACKGROUND OF THE INVENTION

1. Field of the Invention

The present invention relates to the manufacture of cigarette filters, and more particular to the manufacture of a filter rod having a hollow tube extending longitudinally therethrough as an intermediate product in the manufacture of cigarette filters having a smoke flow passage therethrough, and a cigarette filter having the filter rod.

2. Brief Discussion of the Prior Art

Cigarette filters having a smoke flow passage extending longitudinally therethrough, and apparatus for making such filters are known.

Cigarette filters having a longitudinally extending hollow passageway are used to provide a flow of filtered smoke and a separate stream of unfiltered smoke into the smoker's mouth.

By way of example, one such filter and apparatus for manufacturing the filter is shown in U.S. Pat. No. 3,860,011 issued on Jan. 14, 1975 to Vello Norman.

The apparatus of U.S. Pat. No. 3,860,011 includes a garniture funnel and a coaxial hollow mandrel through which a hollow tube is guided into the garniture funnel. The hollow tube is supplied to the hollow tube guide mandrel from a supply reel. The hollow tube supply reel is rotated by a driven wheel in contact with the periphery of the tube supply reel to unwind the tubing from the reel. The unwound tubing passes over a guide roller, around a tensioned take-up roll, and over another guide roller to form a tensional loop of tubing which functions as a reservoir of tubing to accommodate small variations between the speed at which the tubing is unwound from the supply roll and the speed at which the tubing is applied to the filter web in the garniture funnel. In the garniture funnel, the filter material tow is gradually circumferentially wrapped around the hollow tubing.

These are some drawbacks to the heretofore known apparatus of the type disclosed in U.S. Pat. No. 3,860,011. Among these drawbacks is that the apparatus only provides for the hollow tubing being held in place longitudinally in the enwrapping filter material merely by function. Another drawback is that because the hollow tube supplied to the garniture funnel from the tubing supply reel is constantly under tension, it can relatively easily be subjected to a tension greater than its tensile strength causing the hollow tubing to break. In a high volume production facility, the breaking of the supply of hollow tubinig can result in the manufacture of a defective product before the equipment can be shut-down. In addition, in a high volume production facility, equipment down-time is very expensive because of lost production time, the idle time of employees, the expense of getting the equipment back into operation, and over-time expense required to make up production lost during the down-time.

A further drawback is that because the hollow tube is mated with the filter material tow in the garniture funnel under tension, when the filter tow is cut into individual cigarette filters the hollow tube relaxes into the body of the filter. In the event that the tensioned hollow tube is tightly secured to the filter so it will not relax independently of the filter it can occur that the axial force generated by the tensioned hollow tube will cause the filter to bend into a "banana" shape.

The present invention recognizes these drawbacks and provides a solution which is well suited for high volume production of cigarette filters.

SUMMARY OF THE INVENTION

An object of the present invention is to provide an apparatus and method for manufacturing a cigarette filter rod having a longitudinally extending hollow tube therein as an intermediate product in the manufacture of cigarette filters.

Another object of the present invention is an apparatus and method for manufacturing a filter rod of the class described above which provides for a slack loop in the supply of tubing feed to the garniture funnel, thus, greatly reducing the chance of over tensioning the hollow tube which could cause the hollow tube to break.

A further object of the present invention is to provide for the anchoring of the hollow tube in the enwrapping filter material.

More particularly, the present invention provides an apparatus for inserting a hollow tube coaxially in a filter rod comprising a supply reel of hollow tubing to be inserted into the filter rod, driven tube engaging rollers for unwinding tubing from the supply reel, slack loop means for providing a slack loop of hollow tubing, means for maintaining at least a portion of the hollow tubing between the hollow tube supply reel and the tube engaging rollers under a preselected tension, an adhesive or plasticizer applicator downstream of the slack loop means for applying adhesive or plasticizer to the outside wall surface of the hollow tube, a supply of filter material web, a garniture funnel for folding the filter material web in a cylindrical configuration encasing the hollow tube generally longitudinally therein, a hollow tube guide nozzle for guiding the hollow tube into the center of the garniture funnel, and monitoring means operatively associated with the driven tube engaging rollers for continuously monitoring the slack loop of tubing and adjusting the speed of the driven tube engaging rollers to maintain the size of the loop of tubing within predetermined dimensions.

BRIEF DESCRIPTION OF THE DRAWING

The objects, advantages and features of the present invention will become clear upon reference to the following detailed description in conjunction with the accompanying drawings.

DETAILED DESCRIPTION OF THE PREFERRED EMBODIMENT

Figure 1:
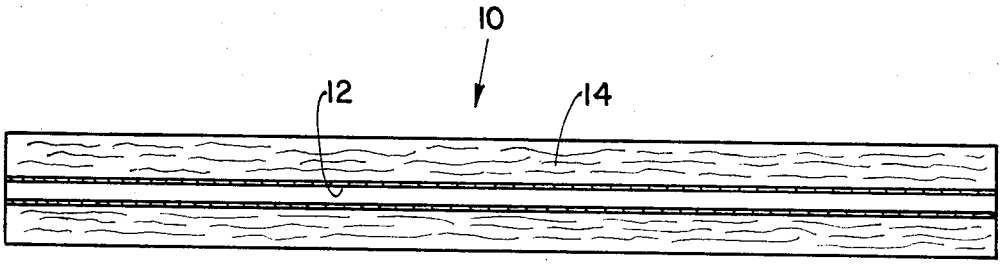
FIG. 1 is a longitudinal cross-sectional view through a portion of a filter rod manufactured by the present invention; and, FIG. 2 is a schematic representation of the apparatus of the present invention for manufacturing a filter rod having a hollow tube longitudinally positioned therein as shown in FIG. 1.

FIG. 1 illustrates, in longitudinal cross-section, a length of filter rod, generally denoted as the numeral 10, of the type manufactured by the present invention. A filter rod in an intermediate product in the manufacture of cigarette filters. The filter rod is cut into cigarette filter lengths, and these cut lengths are attached to one end of a tobacco column with tipping paper in a manner well known in the art, thus, forming a filter cigarette.

With continued reference to FIG. 1, the filter rod 10 comprises a longitudinally extending hollow tube 12 of small diameter enwrapped by a layer of filter material webbing 14. A cigarette filter using the rod 10 provides for the flow of filtered smoke from the cigarette column through the encircling filter material web 14 and a separate stream of unfiltered smoke through the hollow tube 12 into the smoker's mouth.

Figure 2:
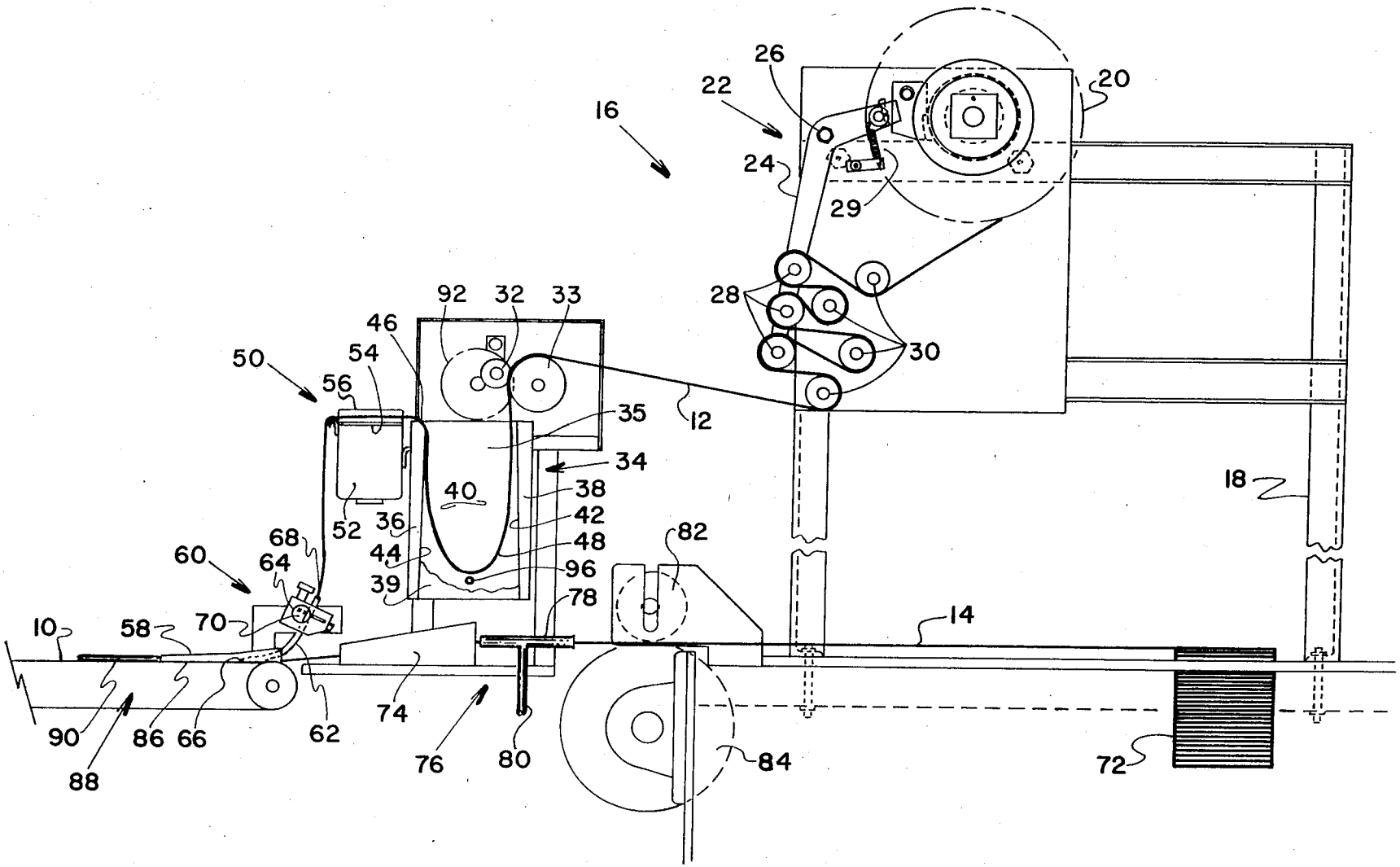

Now with reference to FIG. 2, there is shown, in schematic form, an apparatus, generally denoted as the numeral 16, for manufacturing the filter rod 10 having the hollow tube 12 longitudinally positioned therein as illustrated in FIG. 1.

The apparatus 16 includes a suitable framework, generally denoted as the numeral 18 to which the various components of the apparatus are mounted.

The apparatus 16 includes a supply reel 20 of hollow tubing 12 mounted to a tensioning device, generally denoted as the numeral 22. The tensioning device 22 is shown as an arm 24 rotatably mounted to the framework 18 between its ends by a pivot 26. The supply reel 20 is mounted to the framework 18 next to one end of the arm 24 and three idler rollers 28 are mounted to the other end of the arm 24. A series of four stationary idler rollers 30 are mounted on the framework 18 next to the end of the arm 24 having the three idler rollers 28. The tensioning arm 24 is resilienty biased by, for example, spring 29 such as to move the end of the arm 24 housing the three idler rollers 28 in a direction about the pivot 26 away from the four stationary idler rollers 30.

The hollow tubing 12 is unwound from the supply reel 12 by means of a pair of tube engaging rollers 32 and 33. The hollow tubing 12 from the supply reel 20 is sequentially threaded about alternating ones of the three idler rollers 28 and stationary idler rollers 30 and passes through the nip defined between the tube engaging rollers 32 and 33. One of the rollers 32 and 33, for example roller 32, is driven. Thus, the rollers 32 and 33 frictionally engage the hollowing tubing 12 and continuously unwind the hollow tubing 12 from the supply reel 20. As the hollow tubing 12 is pulled from the supply reel 20, the tensioning arm 24 pivots back and forth about the pivot 26 under the influence of the spring 29 and the pull of the hollow tubing 12 on the three idler rollers 28 so as to maintain a predetermined tension on the hollow tubing 12 between the supply reel 20 and driven tube engaging rollers 32 and 33 so that the unwinding tubing 12 will not become too slack, nor will it be subject to a tension greater than its modulus of elasticity.

Tube loop forming means, generally denoted as the numeral 34, is located downstream, relative to the direction of the unwinding tube 12, from the tube engaging rollers 32 and 33. As shown, the loop forming means comprises an open topped housing formed of a vertical rear wall 35, a pair of spaced apart vertical side walls 36 and 38, and a front wall 39 cooperating to define a loop containing space 40. Preferably, the open topped housing 34 is asymmetrically located relative to the nip between the tube engaging rollers 32 and 33 such that the interior surface 42 of one side wall 38 is closer to the nip than is the interior surface 44 of the other side wall 36. The top end 46 of the side wall 36 is radiused to present a smooth surface for the tubing 12 as it moves over the top end 46 of the side wall 36. The hollow tubing 12 depends through the nip between the tube engaging rollers 32 and 33 into the loop containing space 40 generally along the interior wall surface 42 of wall 38 and makes a U-turn upwardly generally along the interior wall surface 44 of wall 36 and extends in a curve over the radiused top end 46 of the wall 36 to form a slack loop 48 of hollow tubing 12 in the loop containing space 40.

An applicator 50 containing a plasticizer or adhesive is located downstream, relative to the movement of the hollow tubing 12, from the loop forming means 34. The applicator 50 includes a reservoir 52 for containing a supply of liquid adhesive or plasticizer and a pair of overlaying absorbent pads 54 and 56 located at the top of the applicator 50 for absorbing liquid from the reservoir 52. As shown, the applicator 50 is positioned next to the top end 46 of the wall 36 of the loop forming means 34 with the space between the overlaying pads 54 and 56 in generally the same horizontal plane as the top end 46 of the wall 36. The hollow tubing 12 extends from the top end 46 of the loop forming means wall 36 through the space between the pads 54 and 56 so that the pads 54 and 56 apply the liquid to the exterior surface of the hollow tubing 12 as the tubing 12 moves therebetween.

Garniture tonque means 58 is located downstream of the applicator 50. The garniture tongue 58 is adapted to concurrently receive the hollow tubing 12 and the filter material web 14 and fold the filter material web 14 in a cylindrical configuration around the hollow tubing 12 encasing the hollow tubing 12 generally longitudinally therein. Garniture tongues for folding filter material webs into a cylindrical form are well known in the field of cigarette filter manufacture and, therefore, for the sake of brevity, the garniture tongue 58 will not be further described.

A hollow tube guide, generally denoted as the numeral 60, is located at the inlet mount of the garniture tongue 58 for guiding the hollow tubing 12 from the applicator 50 into the center of the garniture tongue 58. Toward this end, the guide 60 includes a length of hollow cylindrical duct 62 attached to an adjustable bracket 64 which is mounted to the framework 18. The duct 62 extends through the inlet mouth of the tongue 58 with the outlet end 66 of the duct 62 located substantially on the longitudinal axis of the tongue 58. The duct 62 is smoothly curved upwardly from its outlet end 66 to an inlet end 68 generally facing the applicator 50. The inside diameter of the duct 62 is large enough so that the hollow tubing 12 will slide smoothly therein. As shown, the adjustable bracket 64 is of the vise type which clamps around a dowel 70 projecting horizontally from the framework 18 perpendicularly to the longitudinal axis of the duct 62. By loosening the vise bracket 64 and pivoting it about the dowel 70, the angular orientation of the duct 62, in a vertical plane, can be adjusted as may be required to accomplish a smooth feed of hollow tubing 12 from the applicator 50 into the duct 62. The hollow tubing 12 descends from the applicator into the duct 62 which guides the hollow tubing 12 to a position within the garniture tongue 58 substantially on the longitudinal axis of the tonque 58.

A supply 72 of filter material web 14 is located to the same side of the garniture tongue 58 as is the supply reel 20 of hollow tubing 12 and below the tubing supply reel 20. A garniture funnel 74 is located immediately upstream of the inlet into the garniture tongue 58 with its outlet end generally coaxial with the longitudinal axis of the garniture tongue 58. Just upstream of the inlet of the garniture funnel 74, there is located a pneumatic filter material feed device 76 of the type known in the art for feeding the filter material web into the garniture funnel 74. Generally, the pneumatic feed device 76 comprises an elongated feed duct 78 generally coaxially aligned with the longitudinal axis of the garniture funnel 74. The pneumatic feed device 76 includes an evacuation tube 80 in gaseous communication with the feed duct 78 and also with suction means (not shown) such as a blower or fan. The filter material web 14 extends from the web supply 72 through the nip between guide rollers 82 and 84 located just upstream of the feed duct 78, and through the feed duct 78. The vacuum created in the feed duct 78 of the pneumatic feed device 76 continuously pulls the filter material web 14 from the web supply 72 and pushes the filter material web 14 through the garniture funnel 74 and through the garniture tongue 58 as is also known in the art. As the filter web 14 moves through the garniture funnel 74, the web 14 is gathered in a smaller bundle. As the gathered filter material web 14 moves in the garniture tongue 58 beneath the tubing outlet end 66 of the duct 62, the tubing 12 moving through the duct 62 is deposited top surface of the gathered filter material web 14 generally centered on the longitudinal axis of the web 14. As is also known in the art, the bottom portion 86 of the garniture tongue 58 is open along the entire length of the garniture tongue 58, and an endless horizontal conveyor belt device 88 is located below the garniture tongue 58 with its top flight 90 horizontally located in the open bottom portion 86 of the garniture tongue 58 and extending in a downstream direction from the garniture tongue 58. Typically, the head pulley or drum of the conveyor belt device 88 is driven by, for example, an electric motor so that the top conveyor flight 90 moves at a constant velocity. The filter material web 14 moving into the garniture tongue 58 is in overlaying position on the top flight 90 of the conveyor belt device 88 and is moved longitudially through the garniture tongue 58 by the top flight 90 of the conveyor belt device 88 at essentially the same linear speed as the linear speed of the top flight 90 of the conveyor belt device 88. The hollow tubing 12 adheres to the fliter material web 14 because of the adhesive or plasticizer applied to its outer surface, and is pulled through the guide duct 62 by moving filter material web 14. As the filter material web 14 and hollow tubing 12 move together through the garniture tongue 58, the taper of the garniture tongue 58 folds the filter web 14 longitudinally about the hollow tubing 12.

The size of the slack loop 48 of hollow tubing 12 in the loop containing space 40 of the loop forming means 34 is monitored and maintained between maximum and minimum sizes to continuously provide a slack, untensioned reservoir of tubing 12 to be fed to the garniture tongue 58. The driven tube engaging roller 32 is driven by, for example, the same motor driving the endless conveyor device 88 through a transmission device 92 having two gear trains of two different drive ratios. The transmission device 92 includes a clutch for selectively engaging one of the other of the two gear trains. Preferably, the clutch is electrically activated. The first one of the two drive ratios drives the roller 32 such that the linear speed of the tubing 12 is faster than the linear speed of web 14 on the conveyor top flight 90, and the second one of the drive ratios drives the roller 32 such that the linear speed of the tubing 12 is slower than the linear speed of web 14 on the conveyor top flight 90. Preferably, the first drive ratio drives the roller 32 to provide a tube speed about two percent faster than the speed of the web 14, and the second drive ratio drives the roller 32 to provide a tube speed, about two percent slower than the speed of the web 14. The clutch of the two speed transmission device 92 is operatively associatd with light emitting means such as, for example, fiber optic device. The light emitting end 96 of the fiber optic device is located within the loop containing space 40 at a predetermined location corresponding to the predetermined maximum size of the loop 48. In operation, the two speed transmission device 92 initially operates at the higher of its two speeds causing the tube loop 48 to increase in size until the tubing 12 of the loop 48 interrupts the light beam from the fiber optic device 94. Interruption of the light beam causes the clutch of the transmission device 92 to shift the transmission device to the slower of its two speeds, thus, causing the tube loop 48 to decrease in size. The transmission device 92 also includes a timer which operates only when the transmission device 92 is operating at the slower of the two speeds. The transmission device 92 operates at the slower of the two speeds for a preselected time as dictated by the timer corresponding to the time required for the loop 48 to reach the minimum predetermined size. After expiration of the preselected time, the transmission device 92 again shifts to the higher of the two speeds until the tube loop 48 again reaches its maximum size interfering with the light beam whereupon it again is shifted to operate at the slower speed.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. An apparatus for installing a hollow tube coaxially in a generally cylindrical filter rod comprising:

means for holding a supply of hollow tubing to be installed in the filter rod;

means for holding a supply of filter material web to be wrapped about the hollow tubing thereby forming the filter rod with the hollow tubing coaxially encased therein;

garniture means spaced from the tubing supply holding means and filter material web holding means for folding the filter material around the hollow tubing;

means for feeding the hollow tubing to the garniture means;

means for feeding the filter material web to the garniture means;

means for forming a loop in the hollow tubing between the hollow tubing supply holding means and the garniture means; and, means for maintaining the loop size between a predetermined maximum and minimum size.

2. The apparatus of claim 1, wherein the loop maintaining means comprises monitoring means for detecting when the slack loop of tubing is at a maximum size.

3. The apparatus of claim 1, wherein the loop forming means comprises means defining a loop containing space.

4. The apparatus of claim 1, further comprising means located between the garniture means and hollow tubing supply holding means for continuously removing hollow tubing from the hollow tubing supply.

5. The apparatus of claim 1, further comprising means located between the garniture means and hollow tubing supply holding means for applying a liquid to the exterior surface of the hollow tubing to cause the hollow tubing to adhere to the filter material web.

6. The apparatus of claim 1, further comprising tubing guide means located between the garniture means and loop forming means for guiding the hollow tubing to the garniture means generally longitudinally with the filter material web at the garniture means.

7. The apparatus of claim 2, wherein the loop monitoring means comprises a photosensitive device, located to detect the loop at its maximum size.

8. The apparatus of claim 5, wherein the liquid applicator means is located downstream of the loop forming means for applying liquid to the exterior surface of the tubing.

9. The apparatus of claim 8, wherein the liquid applicator means comprises an applicator pad adapted to contact the hollow tubing as the hollow tubing moves from the loop forming means to the garniture means.

10. The apparatus of claim 6, wherein the tubing guide means comprises a tube receiving guide duct extending into the garniture means and having a tubing outlet end in the garniture means.

11. The apparatus of claim 1, wherein:

the loop forming means comprises at least one driven roller engaging the tubing from the tubing supply for pulling the tubing therefrom;

means having two speeds for driving the driven feed roller at two different rotational speeds; and, the loop maintaining means comprises monitoring means operatively associated with the feed roller driving means for detecting when the loop of tubing is at a maximum size and for shifting the feed roller driving means to the slower of its two speeds when the loop has reached the maximum size.

12. The apparatus of claim 11, wherein the loop maintaining means further comprises a timer operatively associated with the motor means, the timer being operative only when the feed roller driving means is operating at the slower of its two speeds, and upon expiration of a preselected time dictated by the timer which corresponds to the time required for the loop of tubing to reach a minimum predetermined size the timer causes the feed roller driving means to shift back to the faster of its two speeds.

13. The apparatus of claim 1, wherein the loop forming means comprises means defining a tubing loop containing space having an open top through which the end of tubing loops extend.

14. The apparatus of claim 1, wherein:

(a) the garniture means comprises:

a garniture tongue downstream of the loop forming means for concurrently and coaxially receiving the filter matreial web and hollow tubing, and for at least partially folding the filter material web longitudinally about the hollow tubing; and, a garniture funnel located upstream of the garniture tongue in general axial alignment with the garniture tonque for receiving the filter material web from the filter material web supply and gathering the filter material web into a smaller bundle and guiding the gathered filter material web into the garniture tongue; and (b) tubing guide means located between the loop forming means and garniture means for guiding the hollow tubing into the garniture tongue and into overlay generally longitudinal alignment with the gathered filter material web passing through the garniture tongue.

* * * * *